US006363879B1

(12) United States Patent
Lackey et al.

(10) Patent No.: US 6,363,879 B1
(45) Date of Patent: Apr. 2, 2002

(54) FAN SPEED INDICATOR

(75) Inventors: Robert W. Lackey, Hickory; Roy Nicholson, Boone, both of NC (US)

(73) Assignee: Prime Home Impressions, LLC, Coppell, TX (US)

( * ) Notice: Subject to any disclaimer, the term of this patent is extended or adjusted under 35 U.S.C. 154(b) by 0 days.

(21) Appl. No.: 09/528,554

(22) Filed: Mar. 20, 2000

(51) Int. Cl.[7] ..... G09F 11/02; F04B 49/00

(52) U.S. Cl. ..... 116/200; 116/285; 116/309; 235/144 S

(58) Field of Search ..... 116/200, 202, 116/284, 285, 298, 299, 305, 309; 416/5, 61; 417/63; 235/144 M, 144 C, 144 S, 144 SS, 144 SP

(56) References Cited

U.S. PATENT DOCUMENTS

| | | | | | |
|---|---|---|---|---|---|
| 4,675,663 | A | * | 6/1987 | Corwin | 340/671 |
| 4,762,463 | A | | 8/1988 | Yang | 416/61 |
| 4,768,926 | A | * | 9/1988 | Gilbert, Jr. | 416/61 |
| 5,902,095 | A | * | 5/1999 | Cason et al. | 417/63 |
| 6,238,239 | B1 | * | 5/2001 | Wu | 439/537 |
| 6,241,478 | B1 | * | 6/2001 | Cichetti et al. | 417/63 |

* cited by examiner

*Primary Examiner*—Diego Gutierrez
*Assistant Examiner*—R. Alexander Smith
(74) *Attorney, Agent, or Firm*—John B. Hardaway, III; Nexsen Pruet Jacobs & Pollard, LLC

(57) ABSTRACT

A ceiling fan speed indicator having a detectable feature by which fan speed may be quickly ascertained by one of the human senses.

12 Claims, 3 Drawing Sheets

FAN SPEED INDICATOR

FIELD OF THE INVENTION

The present invention relates to a apparatus for and a method of indicating the speed setting of any multi-setting apparatus operable through the use of a pull chain. More particularly, the apparatus for and method of the present invention relates to a ceiling fan speed indicator.

DESCRIPTION OF RELATED ART INCLUDING INFORMATION DISCLOSED UNDER 37 CFR 1.97 AND 37 CFR 1.98

When approaching a activated ceiling fan, few users, if any, have the capacity to determine a fan speed simply by inspecting the movement of the fan or by listening to the sound produces. Variations in electrical power or current, or mechanical movement are not detectable, without at least some optical or oral reference movement or sound. Thus, to determine fan speed a user will inevitably need to change the fan speed setting to provide some reference for determining the fan's current setting. This takes time and is annoying.

As most users experience, moreover, it is a rare occasion when this reference provides a discernable discrepancy in movement or sound. Such discrepancies are not visible to the naked eye. Nor are they audible to an unaided ear. Without benefit of a discernibly faster, slower, or deactivated fan speed, therefore, a user has no way of knowing a current fan setting, unless the fan motor is off, or in the case of quiet electrical fan motors, unless the fan motor is off and the fan blade has come to rest.

A change in fan speed does not alleviate the problem. Further complicating the problem of determining fan speed setting is the tendency of fan blades, taking benefit of low rotational friction, to continue to rotate even after the fan motor stops. This tendency makes determining fan speed through visual inspection and in a timely fashion, impossible. To resolve the problem, a user is forced to physically stop the movement of the fan by implementing a barrier or wait for it to stop. If the fan is on, of course, the blades do not slow to a stop, so that the user is forced to change the speed setting again with the slight hope that the blade will begin to slow and eventually stop. This process is not only time consuming; it is annoying. Moreover, active attempts to physically impede fan blade movement may damage the fan, user other people, or all three.

Clearly, there is room for improvement in the art.

BRIEF SUMMARY OF THE INVENTION

It is an object of the present invention, therefore, to provide a apparatus for and method of indicating the speed setting of a ceiling fan that allows immediate fan speed detection.

It is a further object of the present invention to provide a apparatus for and method of indicating the speed setting of a ceiling fan that allows relatively continuous fan speed detection.

It is a further object of the present invention to provide a apparatus for and method of indicating the speed setting of a ceiling fan having a detectable feature which changes concurrent with a change in fan speed.

These and other objects may be attained in one aspect of the present invention in a fan speed indicator comprising a fan having an initial speed and a fan speed change mechanism; and an indicator having a detectable feature, such that the indicator is operably connected to the fan speed change mechanism; and wherein the detectable feature perceptibly changes to depict a second fan speed upon activation of the fan speed mechanism so that the change is perceptible to at least one of the unaided human senses.

These and other objects may be attained in a second aspect of the present invention in a fan speed indicator comprising an indicator having a detectable feature; wherein the detectable feature perceptibly depicts the initial speed to at least one of the unaided human senses.

These and other objects of may be attained in a third aspect of the present invention by providing a method comprising the steps of changing the speed of a ceiling fan motor from an initial speed to a second speed, said motor having variable speed settings; providing a speed indicator having a first detectable feature, said first detectable feature being perceptible to at least one human sense and correlating to said initial speed of said fan; and changing said speed indicator simultaneous to said changing of the speed to provide a second detectable feature perceptible to at least one human sense and distinguishable from said first detectable feature by said at least one human sense.

DETAILED DESCRIPTION

Figure 1:
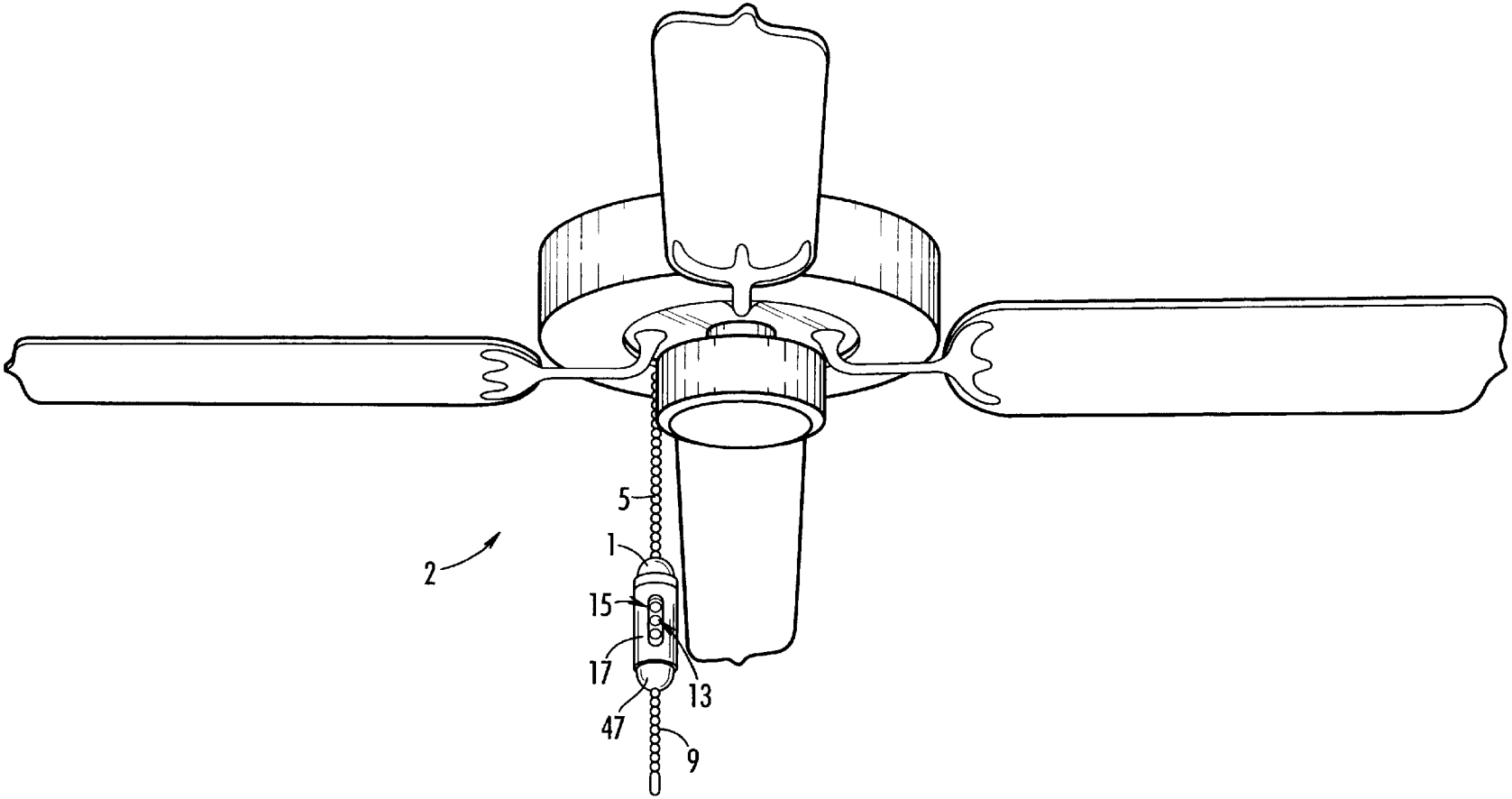
FIG. 1 illustrates a ceiling fan and fan speed indicator, in accordance with the present invention.

When approaching a activated ceiling fan, few users, if any, have the capacity to determine a fan speed simply by inspecting the movement of the fan or by listening to the sound produces. Variations in electrical power or current, or mechanical movement are not detectable, without at least some optical or oral reference movement or sound. Thus, to determine fan speed a user will inevitably need to change the fan speed setting to provide some reference for determining the fan's current setting. This takes time and is annoying.

As most users experience, moreover, it is a rare occasion when this reference provides a discernable discrepancy in movement or sound. Such discrepancies are not visible to the naked eye. Nor are they audible to an unaided ear. Without benefit of a discernibly faster, slower, or deactivated fan speed, therefore, a user has no way of knowing a current fan setting, unless the fan motor is off, or in the case of quiet electrical fan motors, unless the fan motor is off and the fan blade has come to rest.

A change in fan speed does not alleviate the problem. Further complicating the problem of determining fan speed setting is the tendency of fan blades, taking benefit of low rotational friction, to continue to rotate even after the fan motor stops. This tendency makes determining fan speed through visual inspection and in a timely fashion, impossible. To resolve the problem, a user is forced to physically stop the movement of the fan by implementing a barrier or wait for it to stop. If the fan is on, of course, the blades do not slow to a stop, so that the user is forced to change the speed setting again with the slight hope that the blade will begin to slow and eventually stop. This process is not only time consuming; it is annoying. Moreover, active attempts to physically impede fan blade movement may damage the fan, user other people, or all three.

Thus, the present invention provides an apparatus for and method of indicating fan speed without reference to first viewing other speed setting, that is perceptible to at least one of the unaided human senses and which provides a continuous and readily identifiable indication of fan speed. The present invention indicates and allows indication of fan speed visually, such as through a one or more colored or uncolored lights or a number of graphical markings which become visible after mechanical change corresponding to a change in speed setting. The present invention also indicates and allows indication of fan speed orally, such as through a sound emitting apparatus, i.e. one which is operably connected to the motor, electrical circuitry or other fan component, (including a pull chain), which changes with fan speed. The present invention also allows indication of fan speed to other unaided human senses such as touch, taste and smell.

As such the present invention indicates fan speed through one or more of the following human senses, including sight, hearing, taste, smell and touch. As an alternative to graphical indication, the feel of a touch surface may change with a change in the speed setting so that a blind and/or hearing impaired user may use the apparatus to determine speed through the sense of touch. Similar uses of the present invention for fan speed detection by taste and smell will also become apparent to one having ordinary skill in the art.

Thus, a fan speed indicator in accordance with the present invention comprises a fan having an initial speed and a fan speed change mechanism; and an indicator having a detectable feature, such that the indicator is operably connected to the fan speed change mechanism and wherein the detectable feature perceptibly changes to depict a second, i.e. a changed, fan speed upon activation of the fan speed change mechanism. Such a change is perceptible to at least one of the unaided human senses.

In an alternative embodiment, a fan speed indicator in accordance with the present invention comprises an indicator having a detectable feature wherein the detectable feature perceptibly depicts the initial speed of a fan to at least one of the unaided human senses. As used herein, fan speed can be zero such that an off speed setting is the same as a fan speed of zero.

The fan speed change mechanism can be a pull string or pull chain, a mechanically, magnetically, or electrically operable switch, lever or other apparatus, located either on or away from a fan, or any other apparatus or mechanism used for the purpose of activating a fan motor or fan blades, deactivating a fan motor or fan blades, and/or otherwise changing the speed of a fan motor or fan blades.

The detectable feature, which is part of the indicator can be detectable to any of the human senses. It changes upon a change in a speed setting of the ceiling fan. For example, where the feature is visible, it may be in the form of a graphical mark, and LCD display, an LED light source or any other display useful for the purpose. The detectable feature may additionally or alternatively be detectable by virtue of touch, taste, smell or hearing as well. Thus a change of the detectable feature may in addition, or alternatively include variations in a myriad of characteristics including, but not limited to, texture, temperature, feel, sweetness, sourness, bitterness, saltiness, pitch, timbre, frequency of vibration tone or resonation, emitted scent, and/or any variation in intensity of or the combination thereof.

Typically, when a ceiling fan is first activated, the fan motor rotates at the highest of three speed settings. Nonetheless, while running or in cases where a silent fan motor is recently turned off, a user cannot determine fan speed simply by looking at the fan. Therefore, to meet this long-felt need, a preferred embodiment of the present invention provides a ceiling fan speed indicator and a related method of indicating fan speed. Accordingly, a preferred embodiment of a fan speed indicator in accord with the present invention has four distinct graphical markings to depict distinct fan speed, namely the off setting and the three speed settings typical to a ceiling fan motor configuration.

Apparatus

In a preferred embodiment, the apparatus of the present invention includes an indicator having at least one initial detectable feature which perceptibly depicts a fan speed to at least one of the unaided human senses. The indicator includes an outer sleeve, which is preferably cylindrical, and has a bottom end and an inner periphery. The bottom end has a plurality of rachet teeth. The apparatus also includes an inner sleeve, preferably cylindrical, having a plurality of rachet teeth circumferentially disposed about both a top and a bottom end of the inner sleeve. The inner sleeve is disposed within the outer sleeve and is in rotational and longitudinal sliding communication with the inner periphery of the outer sleeve.

The apparatus also includes an upper chain portion connected to the outer sleeve and a lower chain portion connected to the inner sleeve, as well as a coil spring that has a first and second end. The first end is braced against the inner periphery of the bottom end cap, and the second end is braced against a wall member in the inner sleeve. Also included is a top cap having a bottom side and a plurality of rachet teeth circumferentially disposed about its bottom end. The top cap also has a first crimp piece.

The spring provides constant force against the inner sleeve such that when engagement of the rachet teeth on said top end of the inner sleeve with the rachet teeth of the top cap prevents rotational movement of the inner sleeve with respect to the inner periphery of the outer sleeve, wherein engagement of the rachet teeth on the bottom of the inner sleeve with the rachet teeth of the bottom end cap causes the inner sleeve to rotate to cause a second detectable feature to become apparent.

In a preferred embodiment, and as seen in FIG. 1, the apparatus of the present invention comprises a spring-loaded, inner cylinder 3 (not shown in FIG. 1, but shown in FIGS. 3 and 4) encased in a outer cylindrical housing 17 to provide a visual indication of the speed setting of a ceiling fan 2.

Figure 2:
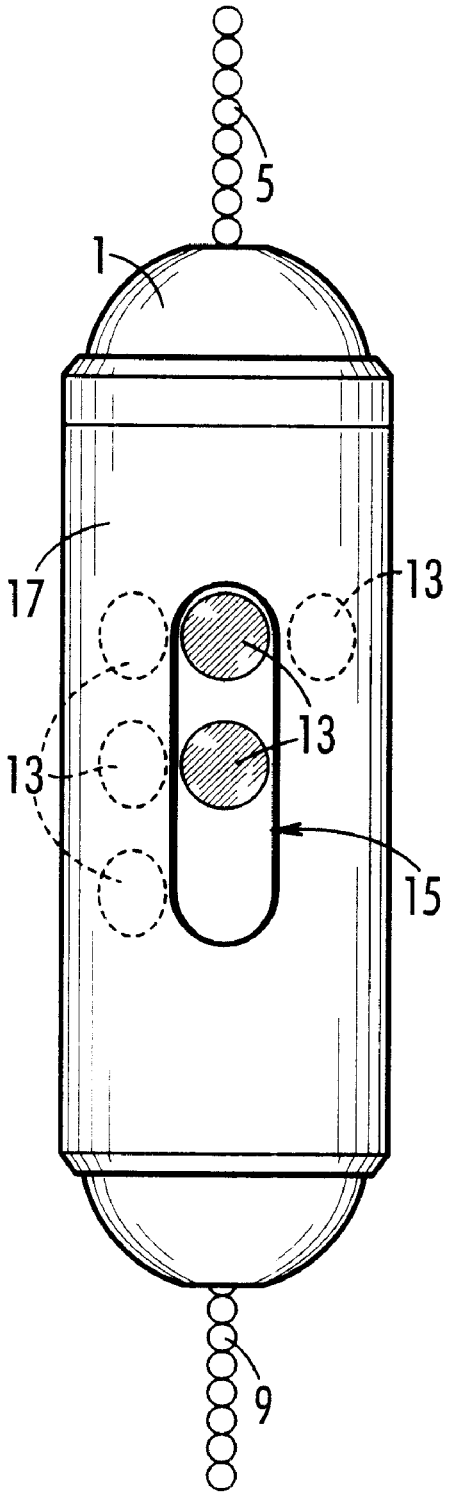
FIG. 2 illustrates a side view of the fan speed indicator in FIG. 1, in accordance with the present invention.
Figure 3:
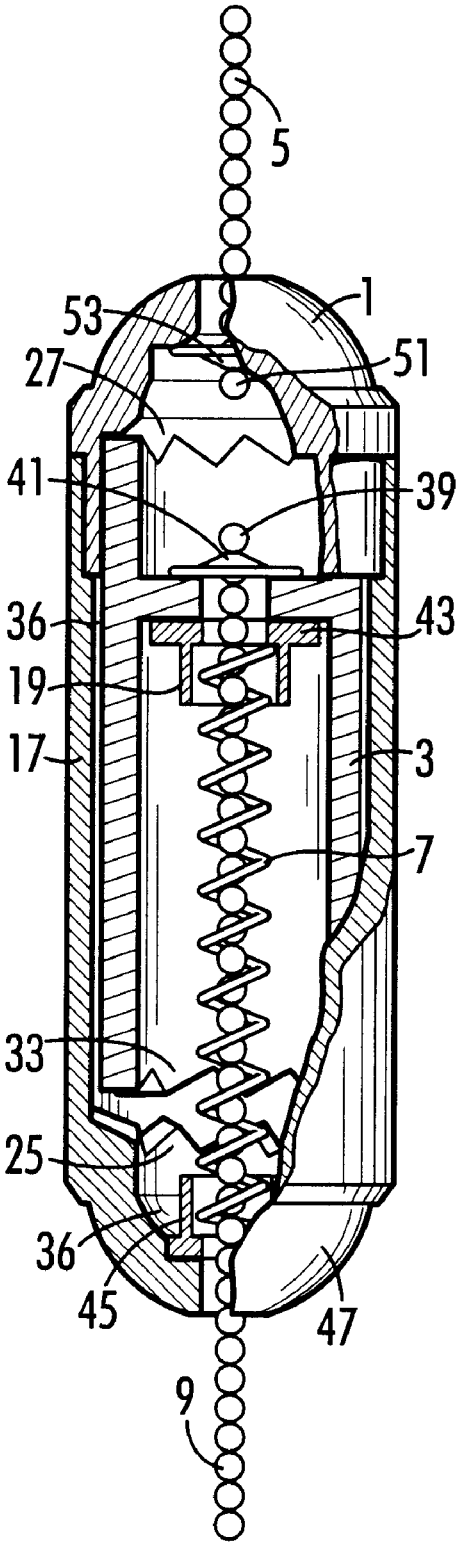
FIG. 3 illustrates a cutaway side view of the fan speed indicator in FIG. 1, in accordance with the present invention.
Figure 4:
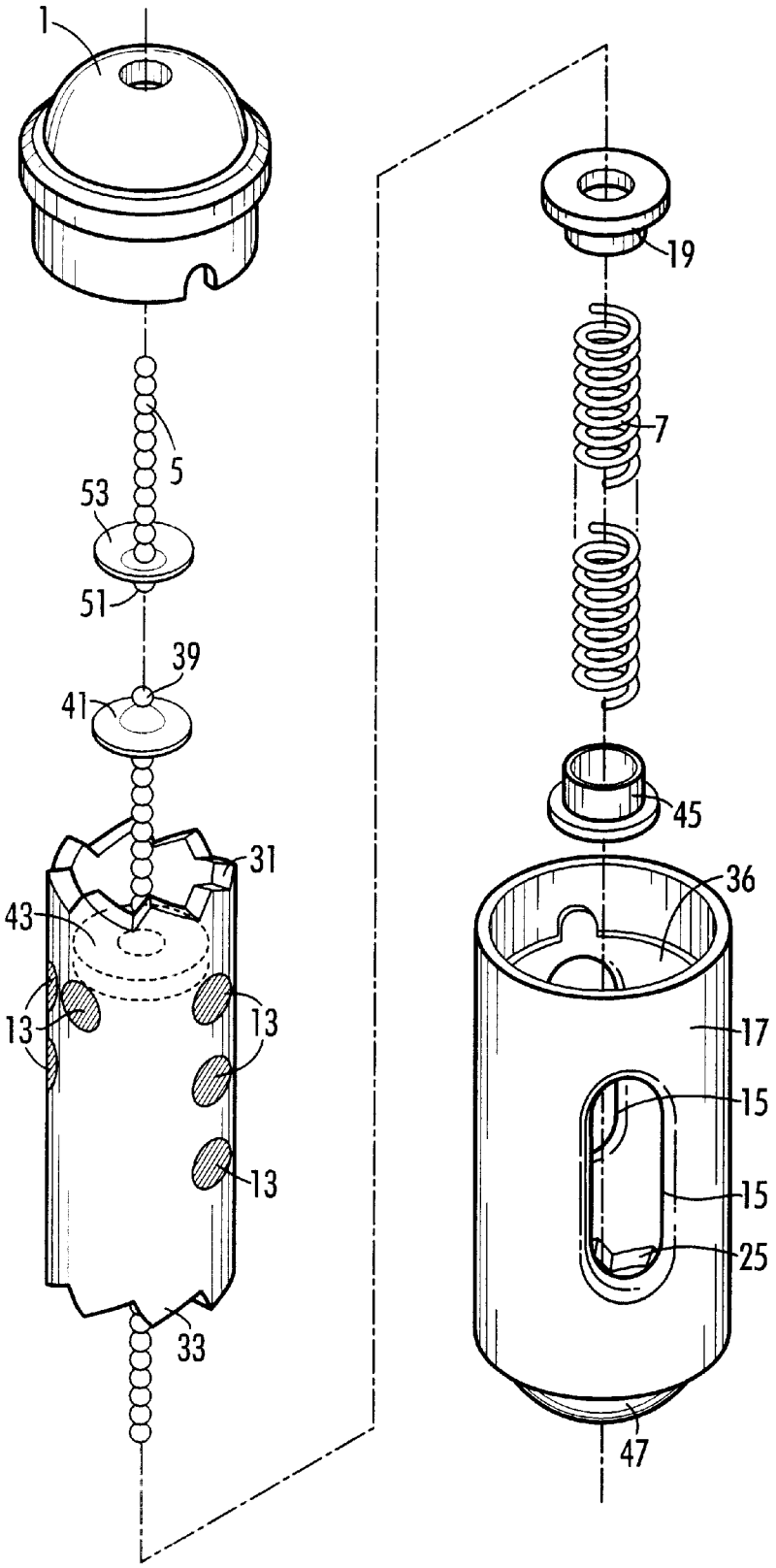
FIG. 4 is an exploded perspective view of the fan speed indicator in FIG. 1, in accordance with the present invention.

When at rest, and as seen in FIGS. 2 and 3, an inner cylinder 3 is pressed up against a cap 1 by spring pressure from spring 7. This causes engagement of upper rachet teeth 27 with a first set of rachet teeth 31 on inner cylinder 3 which prevents rotational motion of inner cylinder 3. Thus, the rotational positioning of inner cylinder 3 with respect to the inner periphery 36 of outer cylinder 17 is locked in place. Accordingly, detectable features, which are preferably graphic marks 13 as seen through the apposing view windows 15 in outer cylinder 17 remain unchanged as long as spring 7 causes engagement of upper rachet teeth 27 with first set of rachet teeth 31.

Upper rachet teeth 27 and first set of rachet teeth 31 become disengaged however upon compression of spring 7 caused by pulling lower chain 9. End 39 of lower chain 9 is crimped and thus secured to inner cylinder 3 via crimping number 41. Similarly, end 49 of upper chain 5 is crimped and thus secured to outer cylinder 17 via crimping member 51. Moreover, spring 7 exerts constant pressure via nylon bushing 19 onto wall 43 of inner cylinder 3. The opposite end of spring 7 exerts pressure via nylon bushing 45 against inner periphery 36 of the lower cap 47 which is part of outer cylinder 17. These bushings 45 and 19 provide a non-abrasive surface against which spring 7 may rest to prevent build up of torsional tension. In addition, outer cylinder 17 is secured to end 49 of upper chain 5 by chain crimping member 51 on cap 1. Upon assembly of the apparatus, cap 1 is secured to outer cylinder 17 such as through sonic welding or other techniques known in the art. Thus cap 1 and outer cylinder 17 are attached to upper chain 5 while inner cylinder 3 is attached to lower chain 9.

Thus, compression of spring 7 which pushes against both of these components causes positioning of graphic marks 13 to change so as to cause an initial detectable feature to disappear and cause a second detectable feature, in this case graphic markings 13, to become apparent. To activate a change in fan motor speed, lower chain 9 is pulled. It is at the initial stages of a full and effective pulling motion, that this embodiment of the present invention operates. As lower chain 9 is pulled it pulls inner cylinder 3 downward, causing spring 7 to be compressed, thereby disengaging the first set of rachet teeth 31 from upper rachet teeth 27 to allow rotational movement of inner cylinder 3 with respect to outer cylinder 17. As inner cylinder 3 longitudinally slides with respect to the inner periphery 36, a second set of rachet teeth 33 approaches and engages lower rachet teeth 25. This causes inner cylinder 3 to rotate 45 degrees with respect to outer cylinder 17. As a result, the graphic marks 13 displayed through view window 15 of outer cylinder 17 change to depict a concurrent change in fan speed.

As downward pulling motion by the user continues and as second set of rachet teeth 33 and lower rachet teeth 25 are engaged, inner cylinder 3 abuts against outer cylinder 17 causing a downward force upon upper chain 5. Therefore, through a single downward pulling motion and sufficient follow-through, a user first causes graphic marks 13 to change through rotation of inner cylinder 3 and then in the same motion, second pulls down on upper chain 5 to activate a change in the fan speed of fan 2. Thus, continued downward motion simultaneously causes the fan speed to change. With each pull the inner cylinder 3 rotates 1/8th turn to expose a new graphic 13 in the two apposing view windows 15 of the outer cylinder 17. As such, this embodiment provides a continuous and readily identifiable indication of fan speed.

Method

In a preferred embodiment, the apparatus of the present invention comprises the steps of changing a speed setting of a ceiling fan motor having variable speed settings and an initial speed; providing an speed indicator having a first detectable feature, said first feature being perceptible to at least one human sense and correlating to the initial speed setting of the fan; and activating a change in said indicator simultaneous to said changing of speed setting to provide a second detectable feature perceptible to at least one human sense and distinguishable from said first detectable feature. The indicator is operably linked to the step of changing the speed setting.

As seen, the present invention provides an apparatus for indicating fan speed comprising a fan having an initial speed and a fan speed change mechanism; and an indicator having a detectable feature, such that the indicator is operably connected to the fan speed change mechanism; and wherein the detectable feature perceptibly changes to depict a second fan speed upon activation of the fan speed mechanism so that the change is perceptible to at least one of the unaided human senses. In addition, the present invention provides an apparatus for indicating fan speed comprising an indicator having a detectable feature; wherein the detectable feature perceptibly depicts the initial speed to at least one of the unaided human senses.

Moreover, the present invention provides a method for indicating fan speed comprising changing the speed of a ceiling fan motor from an initial speed to a second speed, said motor having variable speed settings; providing an speed indicator having a first detectable feature, said first detectable feature being perceptible to at least one human sense and correlating to said initial speed of said fan; and changing said speed indicator simultaneous to said changing of the speed to provide a second detectable feature perceptible to at least one human sense and distinguishable from said first detectable feature.

In accordance with the present invention, therefore, an apparatus for and a method of indicating fan speed is provided. It allows for immediate and relatively continuous fan speed detection. It also has a detectable feature which changes concurrent with a change in fan speed. It will be evident to one skilled in the art that other objects are met by the foregoing invention.

It will be understood that various details of the invention may be changed without departing from the scope of the invention. Furthermore, the foregoing section description is for the purpose of illustration only, and not for the purpose of limitation since the invention is defined by the following claims.

We claim:

1. A fan speed indicator, comprising:

an outer sleeve having a bottom end, top end, and inner periphery;

an inner sleeve having a plurality of ratchet teeth circumferentially disposed about both a top and a bottom end thereof, said inner sleeve being disposed within said outer sleeve and being in rotational and longitudinal sliding communication with said inner periphery of said outer sleeve;

a top cap having a bottom side and a plurality of ratchet teeth circumferentially disposed about a bottom end thereof, said top cap covering said top end of said outer sleeve;

a bottom cap having a top side and a plurality of ratchet teeth circumferentially disposed about a top end thereof, said bottom cap covering said bottom end of said outer sleeve;

a pull chain connected to said top cap;

a lower chain portion connected to said inner sleeve;

a spring braced against said bottom end cap and said inner sleeve, urging said inner sleeve upwardly;

whereby said spring provides force against said inner sleeve such that engagement of said ratchet teeth on said top end of said inner sleeve with said ratchet teeth of said top cap prevents rotational movement of said inner sleeve with respect to said inner periphery of said outer sleeve, and engagement of said ratchet teeth on said bottom of said inner sleeve with said ratchet teeth of said bottom end cap causes said inner sleeve to rotate to cause a detectable feature on said inner sleeve to become visible through said outer sleeve at predetermined rotational positions; and wherein said ratchet teeth on said top and bottom end of said inner sleeve are separately engagable with said ratchet teeth of said top cap and said bottom cap, said inner sleeve being engaged at any one time with either said ratchet teeth of said top cap or bottom cap, but not both.

2. The fan speed indicator according to claim 1 wherein said pull chain is connected to said top cap covering said top end of said outer sleeve by a first crimp piece, and said lower chain portion is connected to said inner sleeve by a second crimp piece.

3. The fan speed indicator according to claim 1 wherein said inner sleeve and said outer sleeve are cylindrical.

4. A speed indicator for a ceiling fan, comprising:

an outer sleeve having a bottom end, top end, and inner periphery;

an inner sleeve having a plurality of ratchet teeth circumferentially disposed about both a top and a bottom end thereof, said inner sleeve disposed within said outer sleeve in rotational and longitudinal sliding communication with said inner periphery;

a top cap positioned at said top end of said outer sleeve, said top cap having a bottom side defining a plurality of ratchet teeth circumferentially disposed thereabout;

a bottom cap positioned at said bottom end of said outer sleeve, said bottom cap having a top side defining a plurality of ratchet teeth circumferentially disposed thereabout;

said ratchet teeth on said top and bottom end of said inner sleeve being separately engagable with said ratchet teeth of said top cap and said bottom cap, said inner sleeve being engaged at any one time with either said ratchet teeth of said top cap or bottom cap, but not both;

wherein relative positions between said inner and outer sleeves from an indicating feature.

5. The speed indicator according to claim 4, further comprising a pulling means attached to said inner sleeve.

6. The speed indicator according to claim 5, wherein said pulling means operates to separate said ratchet teeth of said top of said inner sleeve from said ratchet teeth of said bottom side of said top cap of said outer sleeve and bring said ratchet teeth of said bottom end of said inner sleeve in communication with said ratchet teeth of said top side of said bottom cap, said communication causing said inner sleeve to rotate to the next of a plurality of predetermined rotational settings.

7. The speed indicator according to claim 5, wherein release of said pulling means causes said ratchet teeth of said bottom end of said inner sleeve to disengage with said ratchet teeth of said top side of said bottom cap, and said ratchet teeth of said top of said inner sleeve to reengage with said ratchet teeth of said bottom side of said top cap of said outer sleeve, thereby preventing further rotation of said inner sleeve.

8. The speed indicator according to claim 4, further comprising a plurality of visibly detectable features on said inner sleeve viewable through an aperture in said outer sleeve.

9. The speed indicator according to claim 8, wherein rotation of said inner sleeve causes the next of said plurality of visually detectable features to become visible through said outer sleeve.

10. The speed indicator according to claim 4, further comprising a coil spring holding said ratchet teeth of said top of said inner sleeve in interlocking engagement with said ratchet teeth of said bottom side of said top cap of said outer sleeve.

11. A method for indicating fan speed, comprising:

providing a fan speed indicator for placement on a pull chain of a ceiling fan, said indicator having an outer sleeve, an inner sleeve within a periphery of said outer sleeve, said inner sleeve having a plurality of ratchet teeth circumferentially disposed about both a top and bottom end thereof, a top cap and a bottom cap for said outer sleeve, each said cap having a plurality of ratchet teeth circumferentially disposed about a surface thereof engagable with said inner sleeve, a spring urging said inner sleeve upwardly, and said inner sleeve having a visibly detectable feature viewable through said outer sleeve at predetermined rotational positions;

pulling downwardly on said inner sleeve to pull said pull chain downwardly and causing said ratchet teeth of said top end of said inner sleeve to disengage from said ratchet teeth of a bottom end of said top cap thus also causing said ratchet teeth of said bottom end of said inner sleeve to engage with said ratchet teeth of a top end of said bottom cap thereby causing said inner sleeve to rotate to the next of a plurality of predetermined positions; and releasing said pulling downwardly causing said ratchet teeth of said bottom end of said inner sleeve to disengage with said ratchet teeth of said top end of said bottom cap and thus also causing said ratchet teeth of said top end of said inner sleeve to engage said ratchet teeth of said bottom end of said top cap thereby preventing further rotation of said inner sleeve.

12. The method of claim 11 wherein said rotation causes said detectable feature on said inner sleeve to become visible through said outer sleeve.

* * * * *